US007884298B2

(12) United States Patent
Bickel et al.

(10) Patent No.: US 7,884,298 B2
(45) Date of Patent: Feb. 8, 2011

(54) SWITCH FOR A SWITCHGEAR ASSEMBLY FOR POWER SUPPLY AND DISTRIBUTION

(75) Inventors: Klaus Bickel, Bad Homburg (DE); Heiko Hoffmann, Oestrich-Winkel (DE); Andreas Rößler, Fernwald (DE); Rolf Weber, Karben (DE); Andreas Werner, Kelkheim (DE)

(73) Assignee: Siemens Aktiengesellschaft, Munich (DE)

( * ) Notice: Subject to any disclaimer, the term of this patent is extended or adjusted under 35 U.S.C. 154(b) by 135 days.

(21) Appl. No.: 12/373,576

(22) PCT Filed: Jul. 11, 2007

(86) PCT No.: PCT/EP2007/057083

§ 371 (c)(1),
(2), (4) Date: Mar. 16, 2009

(87) PCT Pub. No.: WO2008/006846

PCT Pub. Date: Jan. 17, 2008

(65) Prior Publication Data

US 2009/0266695 A1 Oct. 29, 2009

(30) Foreign Application Priority Data

Jul. 13, 2006 (DE) ..... 10 2006 033 209

(51) Int. Cl.
*H01H 19/46* (2006.01)

(52) U.S. Cl. ..... 200/519; 200/276; 218/146

(58) Field of Classification Search ..... 200/276, 200/284, 519; 218/146
See application file for complete search history.

(56) References Cited

U.S. PATENT DOCUMENTS 5,828,025 A * 10/1998 Neumaier et al. ..... 218/79
7,211,761 B2 * 5/2007 Vaghini et al. ..... 218/7
7,429,710 B2 * 9/2008 Gutalj et al. ..... 218/79
7,754,992 B2 * 7/2010 Stepniak et al. ..... 218/146

* cited by examiner

*Primary Examiner*—Xuong M Chung Trans
(74) *Attorney, Agent, or Firm*—Laurence A. Green; Werner H. Stemer; Ralph E. Locher

(57) ABSTRACT

A switch for a switching unit for energy supply and distribution includes a first connection and a second connection, each with a cylindrical bolt. The bolts are axially adjacent one another and spaced apart. An annular sleeve with an inner diameter larger than the diameter of the bolts, is arranged in such a way that it can be axially displaced on the bolt of the first connection, and partially on the bolt of the second connection. At least a first contact element is arranged between the surface of the bolt of the first connection and the inner surface of the annular sleeve. At least a second contact element is arranged and constructed in such a way that it can be positioned between the surface of the bolt of the second connection and the inner surface of the annular sleeve. The switch has an annular third connection, the inner diameter of which is greater than an outer diameter of the annular sleeve, and which is arranged such that the sleeve can be shifted between the bolts of the first connection and the annular third connection. At least a third contact element is arranged and constructed in such a way that it can be positioned between the inner surface of the annular third connection and the outer surface of the annular sleeve.

17 Claims, 5 Drawing Sheets

SWITCH FOR A SWITCHGEAR ASSEMBLY FOR POWER SUPPLY AND DISTRIBUTION

BACKGROUND OF THE INVENITION

Field of the Invention

The present invention relates to a switch, in particular a switch disconnector, for a switchgear assembly for power supply and distribution.

Switch disconnectors are used, for example, as three-position switches in a gas-insulated switchgear assembly. Such a three-position switch is a combined disconnection and grounding switch, which can assume three switching positions: "on", "off" and "ground". In the "on" switching position, the three-position switch connects a circuit breaker to a busbar. In the "ground" switching position, the three-position switch connects the circuit breaker to a ground potential, and in the "off" switching position, the circuit breaker is disconnected both from the busbar and from the ground potential.

The present invention is based on the object of making possible a switch, in particular a switch disconnector, with a simple construction and reliable functionality with a compact design.

BRIEF SUMMARY OF THE INVENTION

This object is achieved by the technical teaching of the independent claims. Advantageous configurations of the invention are given in the dependent claims.

According to the invention, the switch contains a first connection, which has a pin, a second connection, which has a pin, which is arranged in an axial extension of the pin of the first connection adjacent thereto and spaced apart therefrom in axially aligned fashion. In addition, a sleeve is provided whose opening dimension is greater than the cross-sectional dimension of the pins of the first connection and of the second connection, and which is arranged in such a way that it is axially displaceable on the pin of the first connection and partially on the pin of the second connection. At least one first contact element is arranged between the surface of the pin of the first connection and the inner surface of the sleeve, and at least one second contact element is arranged and configured in such a way that it is located between the surface of the pin of the second connection and the inner surface of the sleeve if the sleeve is partially displaced onto the pin of the second connection. The switch furthermore has a third connection, which is provided with an opening and whose opening dimension is greater than an outer dimension of the sleeve and which is arranged in such a way that the sleeve is displaceable between the pins of the first connection and the third connection. At least one third contact element is arranged and configured in such a way that it is located between the inner surface of the third connection and the outer surface of the sleeve if the sleeve has been displaced between the pins of the first connection and the third connection.

The switch according to the invention can in particular be in the form of a switch disconnector, for example in the form of a three-position switch in a switchpanel for a gas-insulated switchgear assembly. The sleeve of the switch can be displaced by means of a translatory movement, with the result that three switching positions can be set by means of this displacement. A first switching position can advantageously be set via the sleeve by virtue of said sleeve being displaced approximately completely over the pin of the first connection without being in contact with the at least one second and the at least one third contact element. A second switching position can advantageously be set via the sleeve, with the at least one first contact element and the at least one second contact element by virtue of contact being produced between the pins of the first and the second connection. A third switching position can advantageously be set via the sleeve, the at least one first contact element and the at least one third contact element by virtue of contact being produced between the pin of the first connection and the third connection. In the case of the switch disconnector according to the invention, the pins of the first and the second connection, the sleeve and the third connection are spaced apart from one another in order to ensure the required voltage separation. The contact between these components is produced exclusively via the contact elements.

Owing to the present invention, the complexity in terms of fitting for fitting the switch can advantageously be kept very low. In addition, the displacement of the sleeve is particularly simple, with the result that reliable functionality and low complexity in terms of maintenance are ensured. Furthermore, the switch according to the invention requires only a very small amount of space. It is constructed from particularly few component parts and adjustment work is required to a very limited extent. The switch advantageously ensures a high number of operating cycles, a high rated current carrying capacity and a high short-circuit current carrying capacity. The switch is particularly suitable for medium-voltage assemblies. It can be produced very inexpensively.

In an advantageous configuration of the invention, the pin of the first connection is guided through the opening of the third connection. As a result, a particularly suitable displacement path is fixed in order to produce a contact between the first and the third connection.

In a further, particularly advantageous configuration, the sleeve has at least one holder for the at least one third contact element on the outer surface of said sleeve. The at least one third contact element can be mounted securely in this holder. In addition, this arrangement ensures particularly reliable contact between the first and the third connection.

Preferably, the at least one holder has two webs, which are arranged parallel to one another and between which there is embedded the at least one third contact element. A groove is formed between the two webs, in which groove the at least one third contact element can be arranged. The groove walls can run in particular at an angle with respect to the groove base which is greater than 90°. The at least one third contact element can be arranged particularly securely in the trapezoidal groove.

Particularly preferably, the opening dimension of the annular third connection is greater than the outer dimension of the sleeve at the position of the holder. As a result, the third connection can be displaced over the holder in a simple and reliable manner.

Preferably, the cross-sectional dimensions of the pins of the first connection and of the second connection are at least approximately the same. This ensures a simple construction, in particular of the sleeve, which can be displaced over the two pins. In addition, this simplifies the alignment of the two pins.

Further preferably, the at least one first contact element is arranged on the pin of the first connection. This is particularly simple in terms of fitting and ensures a very good contact between the pin of the first connection and the sleeve.

Preferably, the at least one second contact arrangement is arranged on the pin of the second connection. This is likewise very simple in terms of fitting and ensures a particularly good contact between the pin of the second connection and the sleeve. Alternatively, the second contact element can also be arranged on the pin of the first connection, however.

Particularly preferably, in a further variant embodiment, at least two in particular annular cutouts, which are spaced apart from one another in the axial direction, for accommodating the at least one first contact element and of the at least one second contact element are provided in the inner surface of the sleeve. The cutouts can be in the form of grooves with a trapezoidal groove cross-section. This ensures a secure hold of the contact elements and particularly reliable contacts.

Preferably, the pins of the first connection and of the second connection, the sleeve and the third connection are produced from an electrically conductive material, for example from a material which contains copper. Copper conducts electrical current particularly well and ensures good stability of the switch.

Further preferably, the at least one first contact element and/or the at least one second contact element and/or the at least one third contact element are designed to be spring-elastic. For example, the at least one first contact element and/or the at least one second contact element and/or the at least one third contact element can have at least one annular spring or a laminated contact or be in the form of an annular spring or laminated contact. In particular, the annular springs ensure good contact and are dimensionally stable. They are particularly well suited for the mounting of the sleeve.

Preferably, the pin of the first connection is used for connecting the switch disconnector to a circuit breaker. The pin of the second connection is preferably a leadthrough pin for connecting the switch disconnector to a busbar and the third connection is preferably used for connecting the switch disconnector to a ground potential. As a result of this assignment of the connections, the switch disconnector according to the invention is particularly well suited for reliable use in a switchgear assembly.

The invention and the advantages thereof will be explained in more detail below with reference to examples and exemplary embodiments and the attached drawing, in which:

DESCRIPTION OF THE INVENTION

Identical and functionally identical elements, if not otherwise specified, have been provided with the same reference symbols below in the figures.

Figure 1:
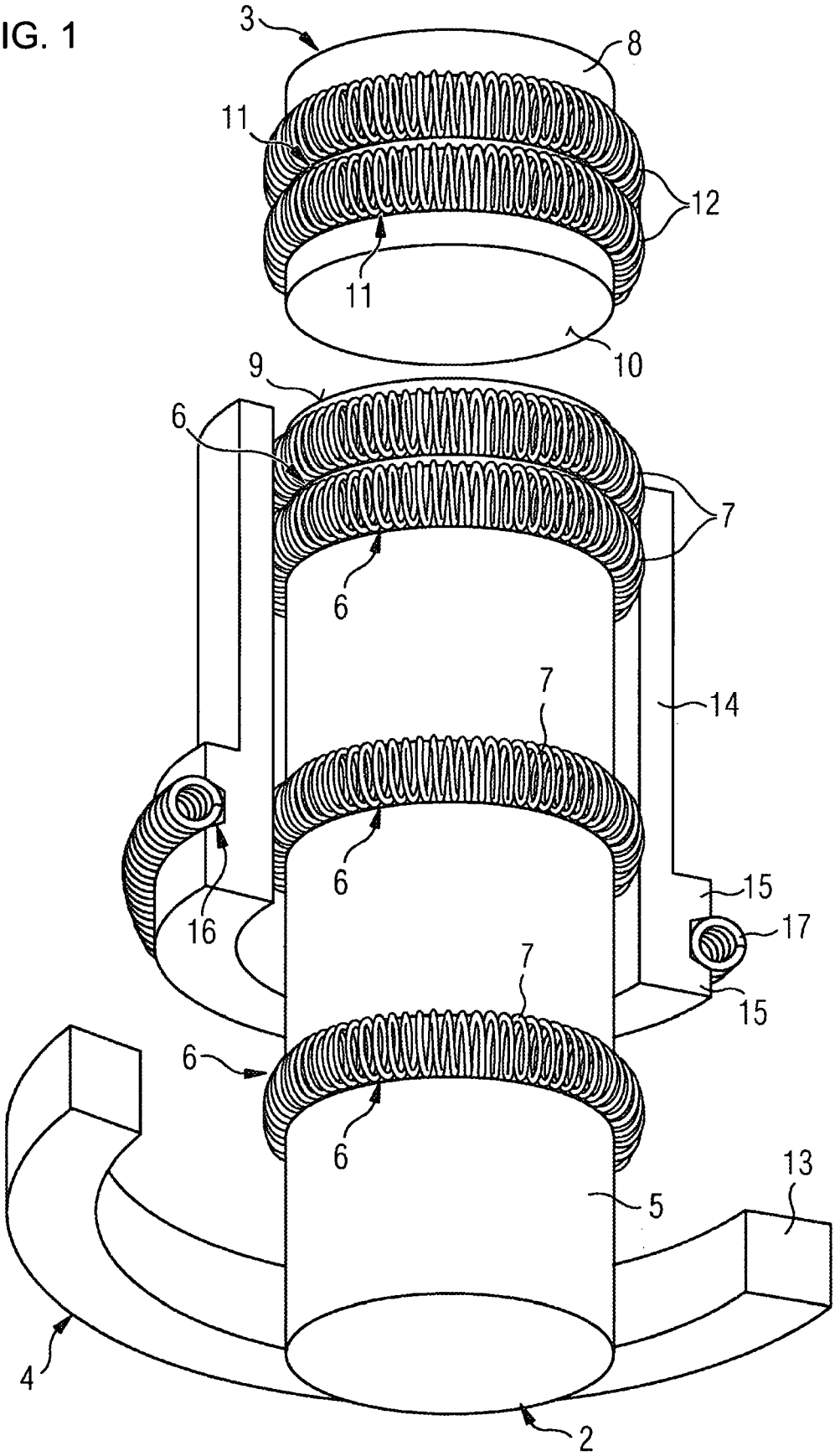
FIG. 1 shows a schematic illustration of a first exemplary embodiment of a switch disconnector according to the invention.

FIG. 1 shows a schematic, partially sectioned illustration of a first exemplary embodiment of a switch disconnector 1 according to the invention. The switch disconnector 1 is in this case a so-called three-position switch, which can be used in particular for power supply and distribution in gas-insulated medium-voltage assemblies. The switch disconnector 1 has a first connection 2, which is used for connecting the switch disconnector 1 to a circuit breaker, and a second connection 3, which is used for connecting the switch disconnector 1 to a busbar. The switch disconnector 1 also contains a third connection 4 for connecting the switch disconnector 1 to a ground potential.

The first connection 2 has a cylindrical, elongate pin 5, with a plurality of annular cutouts or grooves 6 being introduced into the surface of said pin. In the present exemplary embodiment shown in FIG. 1, four such grooves 6 are introduced into the surface of the pin 5. The grooves 6 are arranged so as to be offset in the axial direction and parallel to one another. In this case, two grooves 6 are positioned directly next to one another in an upper end region of the pin 5. The two further grooves 6 follow with a larger separation. Annular springs 7, which act as the first contact elements and are constructed from an electrically conductive material, are inserted into the grooves 6 of the pin 5.

The second connection 3 of the switch disconnector 1 has a cylindrical pin 8. The pin 8 is preferably a leadthrough pin which can be used for leading through a housing opening or for direct connection to the busbar. The pin 8 is arranged in an axial extension of the pin 5 such that it is adjacent thereto. The axes of the two pins 5, 8 therefore lie on a common straight connecting line, i.e. are jointly aligned. The two pins 5, 8 are spaced apart from one another and their diameters are at least approximately equal in size. An upper end face 9 of the pin 5 is directly opposite a lower end face 10 of the pin 8. A plurality of annular cutouts or grooves 11 are introduced into the surface of the pin 8. In the present exemplary embodiment shown in FIG. 1, two such grooves 11 are introduced into the surface of the pin 8. The grooves 11 are arranged so as to be offset in the axial direction and parallel to one another. In this case, the two grooves 11 are positioned directly next to one another in a lower end region of the pin 8. Annular springs 12, which act as second contact elements and are constructed from an electrically conductive material, are inserted into the grooves 11 of the pin 8.

The third connection 4 in this case has a ring 13. The pin 5 is in this case guided through the ring 13. Here, the ring 13 is arranged centrically with respect to the longitudinal axis of the pin 5. The ring 13 can, for example, be pressed into a housing of the switch disconnector 1 or screwed thereto.

The switch disconnector 1 has an annular sleeve 14, which is mounted displaceably in the longitudinal direction on the pin 5. For this purpose, the pin 5 is guided through the annular sleeve 14. The sleeve 14 is likewise arranged centrically with respect to the longitudinal axis of the pin 5. The sleeve 14 has an elongate extension, which is at least so large that the sleeve 14 can bridge the gap between the two pins 5, 8 and in the process covers the springs 7 and 12, respectively, which are arranged in the two end regions of the pins 5 and 8, respectively. In a lower end region of its outer surface, the sleeve 14 has two outwardly pointing annular webs 15, which are arranged in the circumferential direction of the sleeve 14 parallel to one another and spaced apart from one another. As a result, a cutout or groove 16 is formed between the two webs, which cutout or groove represents a holder for a further annular spring 17. The walls of the groove run in the radial direction at an angle of more than 900 with respect to the groove base, with the result that a trapezoidal groove cross section is provided. The spring 17 acts as the third contact element and is likewise constructed from an electrically conductive material.

The inner diameter of the sleeve 14 is greater than the diameter of the pins 5 and 8. These diameters are in this case selected such that the springs 7 and 12, respectively, are arranged between the pins 5, 8 and the sleeve 14. The sleeve 14 is mounted so as to be displaced onto the springs 7, 12. In addition, the outer diameter of the sleeve 14 given by the two webs 15 is smaller than the inner diameter of the ring 13. These diameters are in this case selected such that the spring 17 is arranged between the ring 13 and the sleeve 14. The dimensions and the arrangements of the pins 5, 8, the sleeve 14, the ring 13 and the springs 7, 12, 17 are selected such that there is a conductive contact between the pin 5 and the sleeve 14 by means of the spring 7, a conductive contact between the pin 8 and the sleeve 14 can be produced by means of the springs 12 given suitable positioning of the displaceable sleeve 14, and a conductive contact between the ring 13 and the sleeve 14 can be produced by means of the spring 17 given suitable positioning of the displaceable sleeve 14.

The pins 5, 8, the sleeve 14 and the ring 13 are in this case made from an electrically conductive material.

Figures 2A, 2B, 2C:
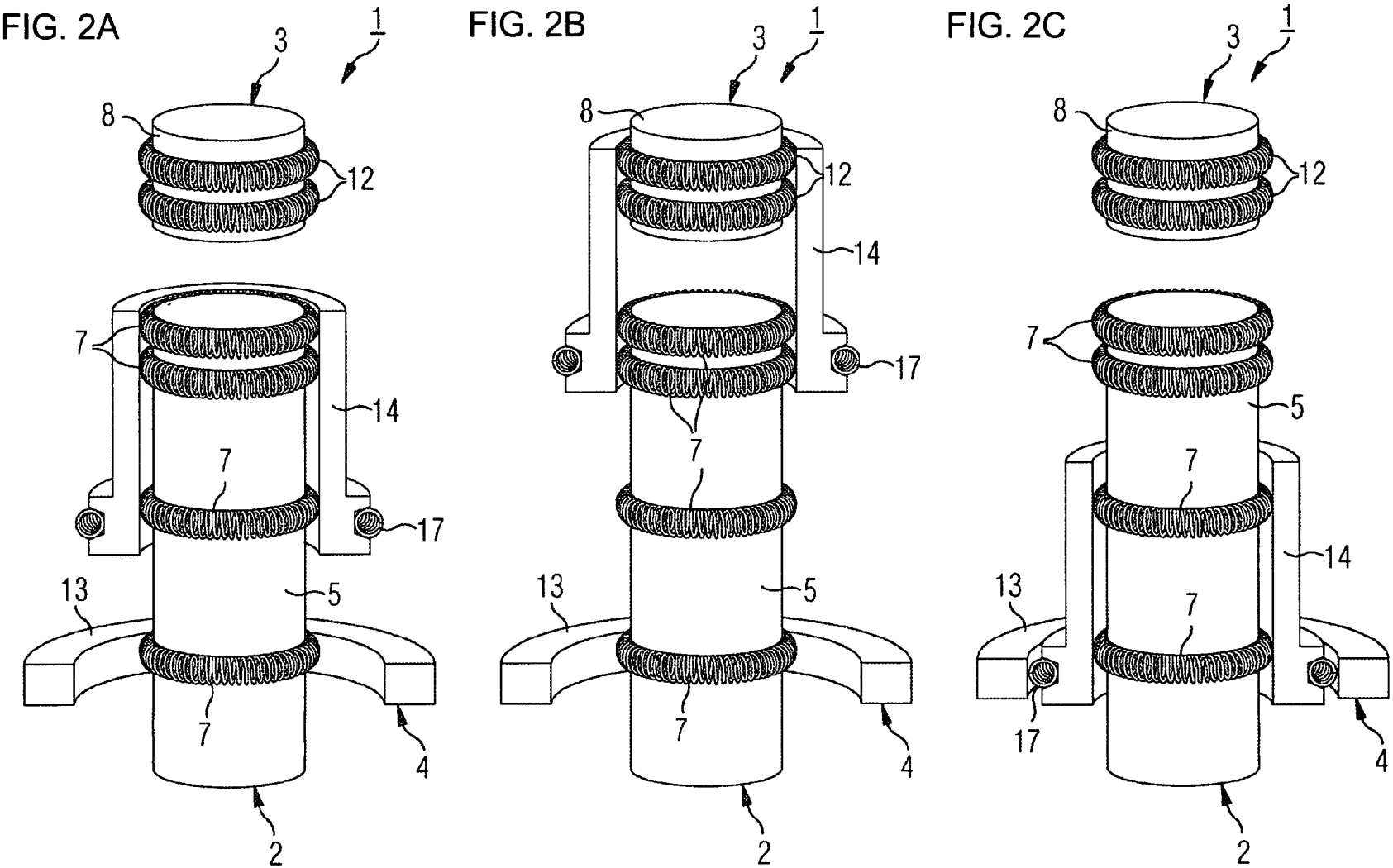
FIGS. 2A-2C show a schematic illustration of the switch disconnector according to the invention shown in FIG. 1 in three different switching positions.

FIGS. 2A-2C show a schematic illustration of the switch disconnector 1 according to the invention in three different switching positions. FIG. 2A illustrates a switching position in which the switch disconnector 1 is switched off, i.e. it is located in its "off" switching position. In this "off" switching position, the sleeve 14 is located in a position in which its inner surface only has contact with one or more of the springs 7 on the pin 5 of the first connection 2, but no contact with one of the springs 12 of the pin 8, and the spring 17 on the outer surface of the sleeve 14 has no contact with the ring 13.

FIG. 2B illustrates a switching position in which the switch disconnector 1 is switched on, i.e. it is located in its "on" switching position. In this "on" switching position, the sleeve 14 is located in a position in which it bridges the gap between the pin 5 and the pin 8 and a lower end region of its inner surface is in contact with the two springs 7 arranged in the upper end region of the pins 5. At the same time, an upper end region of the inner surface of the sleeve 14 is in contact with the two springs 12 arranged in the lower end region of the pin 8. In this way, the pin 5 and the pin 8 are therefore electrically conductively connected to one another via the springs 7, the sleeve 14 and the springs 12. The circuit breaker which is connected, for example, to the first connection 2, is therefore electrically conductively connected to the busbar, which is connected to the second connection 3.

FIG. 2C illustrates a switching position in which the switch disconnector 1 is connected to the ground potential, i.e. it is located in its "ground" switching position. In this "ground" switching position, the sleeve 14 is located in a position in which it bridges the gap between the pin 5 and the ring 13. The sleeve 14 is displaced in such a way that the webs 15 attached to its outer surface, when viewed in the transverse direction, lie adjacent to the inner surface of the ring 13. The spring 17, which is embedded in the groove 16 between the webs 15, touches the inner surface of the ring 13. Owing to the fact that the sleeve 14 is mounted on the springs 7, at the same time there is contact between the sleeve 14 and the pin 5. In this way, the pin 5 and the ring 13 are therefore electrically conductively connected to one another via the springs 7, the sleeve 14 and the spring 17. The circuit breaker, which is connected, for example, to the first connection 2, is therefore electrically conductively connected to the ground potential, which is connected to the third connection 4. The three different switching positions of the switch disconnector 1 are set by means of a translatory displacement movement of the sleeve 14.

Figure 3:
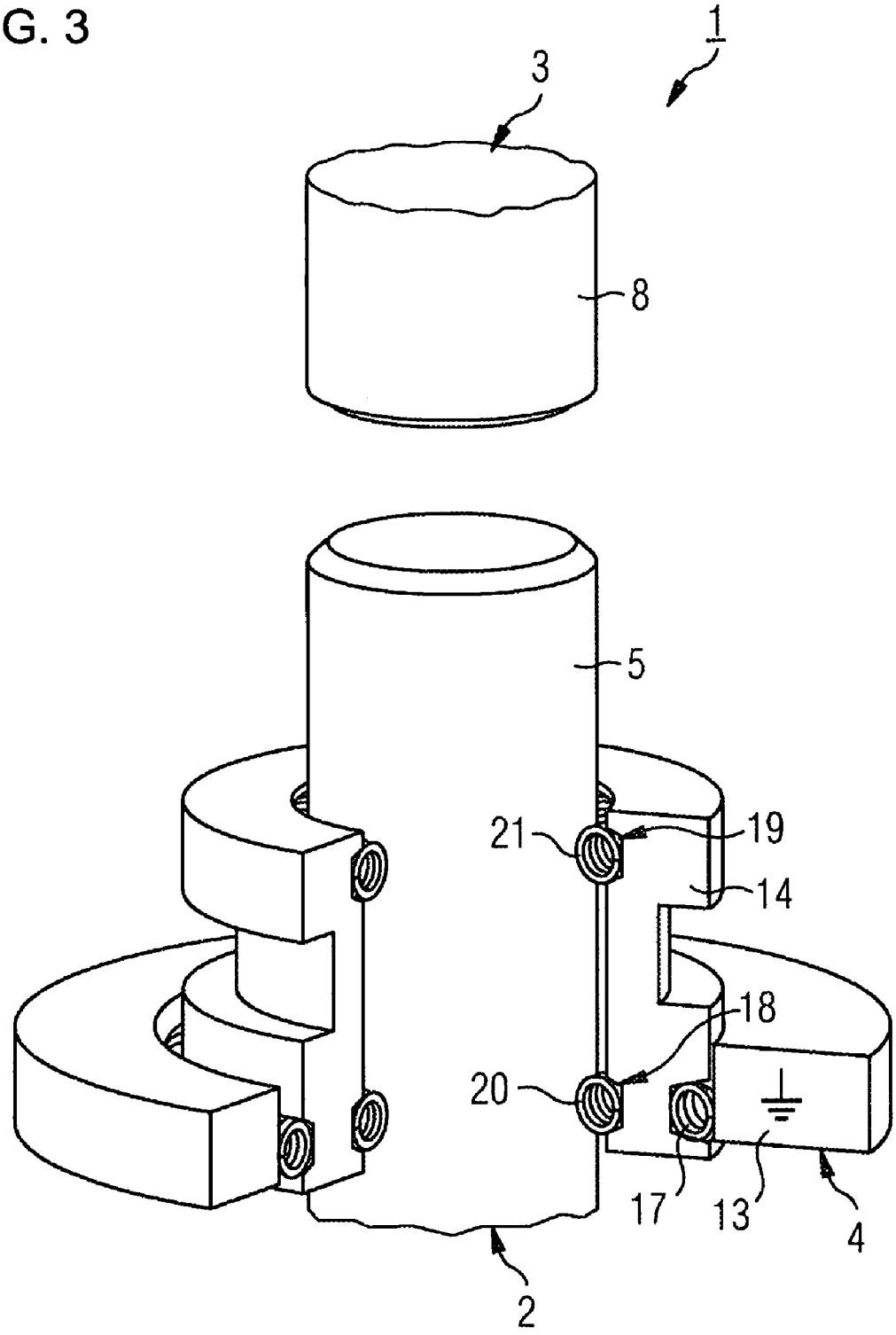
FIG. 3 shows a schematic illustration of a second exemplary embodiment of a switch disconnector according to the invention.

FIG. 3 shows a schematic illustration of a second exemplary embodiment of the switch disconnector 1 according to the invention. The switch disconnector 1 in accordance with the second exemplary embodiment likewise contains the pins 5 and 8, the sleeve 14 and the ring 13. In addition, the two webs 15, between which the spring 17 is embedded in the groove 16, are provided on the outer surface of the sleeve 14. In contrast to the switch disconnector 1 in accordance with the first exemplary embodiment shown in FIG. 1, no springs 7 or 12 are let into the pins 5 and 8 in the case of the switch disconnector 1 in accordance with the second exemplary embodiment. In the present second exemplary embodiment, two annular trapezoidal grooves 18 and 19 are introduced into the inner surface of the sleeve 14, and two annular springs 20 and 21, respectively, are arranged in said trapezoidal grooves. The configurations and properties of the springs 20, 21 correspond in principle to those of the springs 7, 12. The grooves 18, 19 are spaced apart from one another in the axial direction. The groove 18 is introduced in a lower peripheral region and the groove 19 in an upper peripheral region of the sleeve 14 in the inner surface thereof. The spring 20 located in the groove 18 acts as the first contact element. The spring 21 located in the groove 19 likewise acts as the first contact element if the sleeve 14 has been completely pushed onto the pin 5. If the sleeve 14 has been pushed partially upwards onto the pin 8, with the result that the spring 21 comes into contact with the surface of the pin 8, the spring 21 acts as the second contact element.

Figures 4A, 4B, 4C:
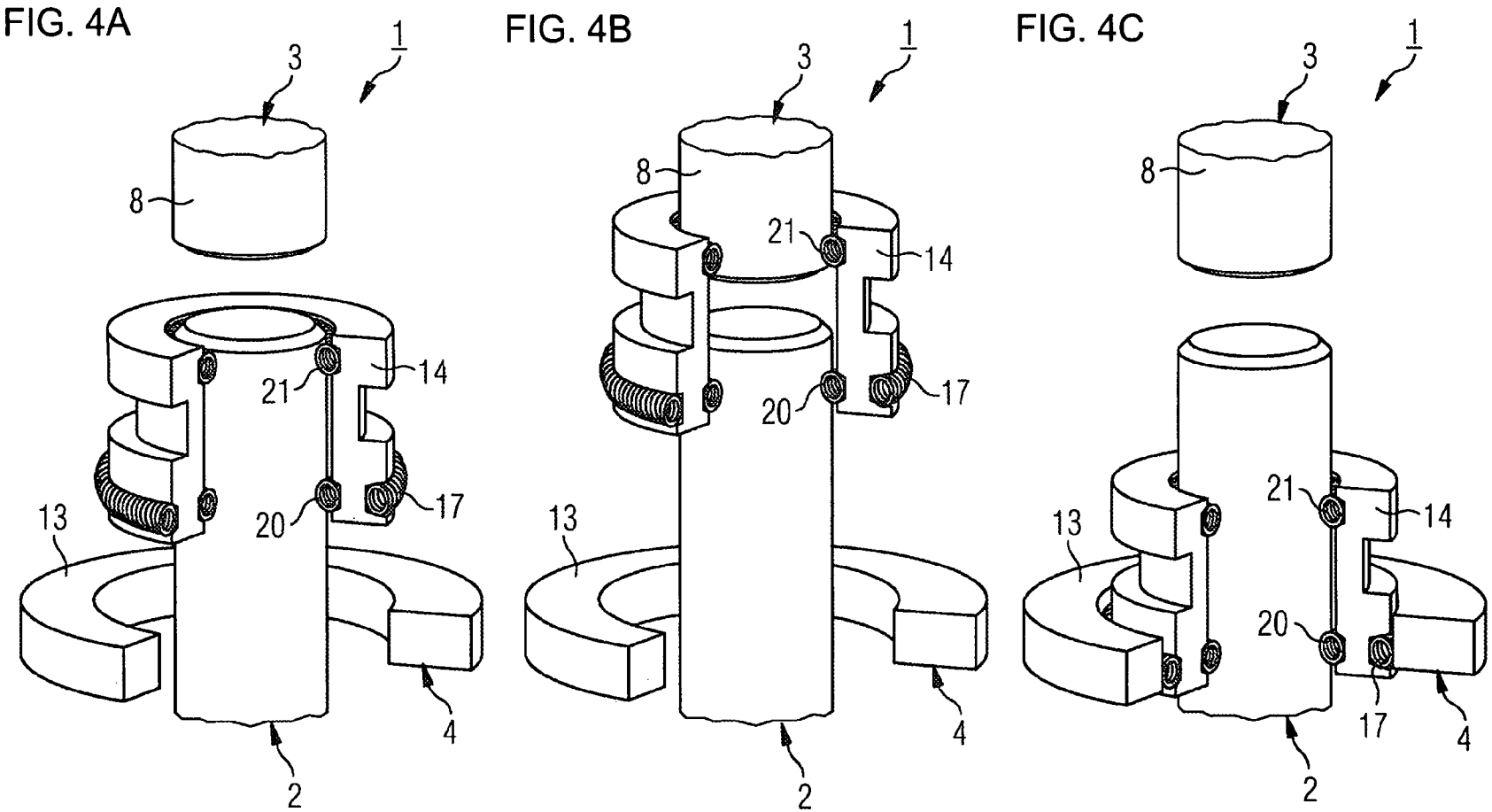
FIGS. 4A-4C show a schematic illustration of the switch disconnector according to the invention shown in FIG. 3 in three different switching positions.

FIGS. 4A-4C show a schematic illustration of the switch disconnector 1 according to the invention in accordance with the second exemplary embodiment shown in FIG. 3 in three different switching positions. FIG. 4A illustrates a switching position in which the switch disconnector 1 is switched off, i.e. it is located in its "off" switching position. In this "off" switching position, the sleeve 14 is located in a position in which it is completely pushed onto the pin 5. The springs 20, 21, which have been introduced into the inner surface of the sleeve 14, are in contact with the surface of the pin 5 of the first connection 2, but not in contact with the surface of the pin 8. In addition, the spring 17 is not in contact with the ring 13 on the outer surface of the sleeve 14.

FIG. 4B illustrates a switching position in which the switch disconnector 1 is switched on, i.e. it is located in its "on" switching position. In this "on" switching position, the sleeve 14 is located in a position in which it bridges the gap between the pin 5 and the pin 8 and the spring 20, which is arranged in its lower peripheral region in the inner surface, is in contact with the surface of the pin 5. At the same time, the spring 21, which is arranged in the upper peripheral region of the sleeve 14 in the inner surface thereof, is in contact with the surface of the pin 8. In this way, the pin 5 and the pin 8 are therefore electrically conductively connected to one another via the spring 20, the sleeve 14 and the spring 21. The circuit breaker, which is connected, for example, to the first connection 2, is therefore electrically conductively connected to the busbar, which is connected to the second connection 3.

FIG. 4C illustrates a switching position in which the switch disconnector 1 is connected to the ground potential, i.e. it is located in its "ground" switching position. In this "ground" switching position, the sleeve 14 is located in a position in which it bridges the gap between the pins 5 and the rings 13. The sleeve 14 has been displaced in such a way that the webs 15 fitted to its outer surface, when viewed in the transverse direction, lie adjacent to the inner surface of the ring 13. The spring 17, which is embedded in the groove 16 between the webs 15, captures the inner surface of the ring 13. By virtue of the fact that the sleeve 14 has additionally been completely pushed onto the pins 5, the two springs 20, 21 are in contact with the pins 5. In this way, the pins 5 and the rings 13 are therefore electrically conductively connected to one another via the springs 20, 21, the sleeve 14 and the spring 17. The circuit breaker which is connected, for example, to the first connection 2 is therefore electrically connected to the ground potential, which is connected to the third connection 4.

Figure 5:
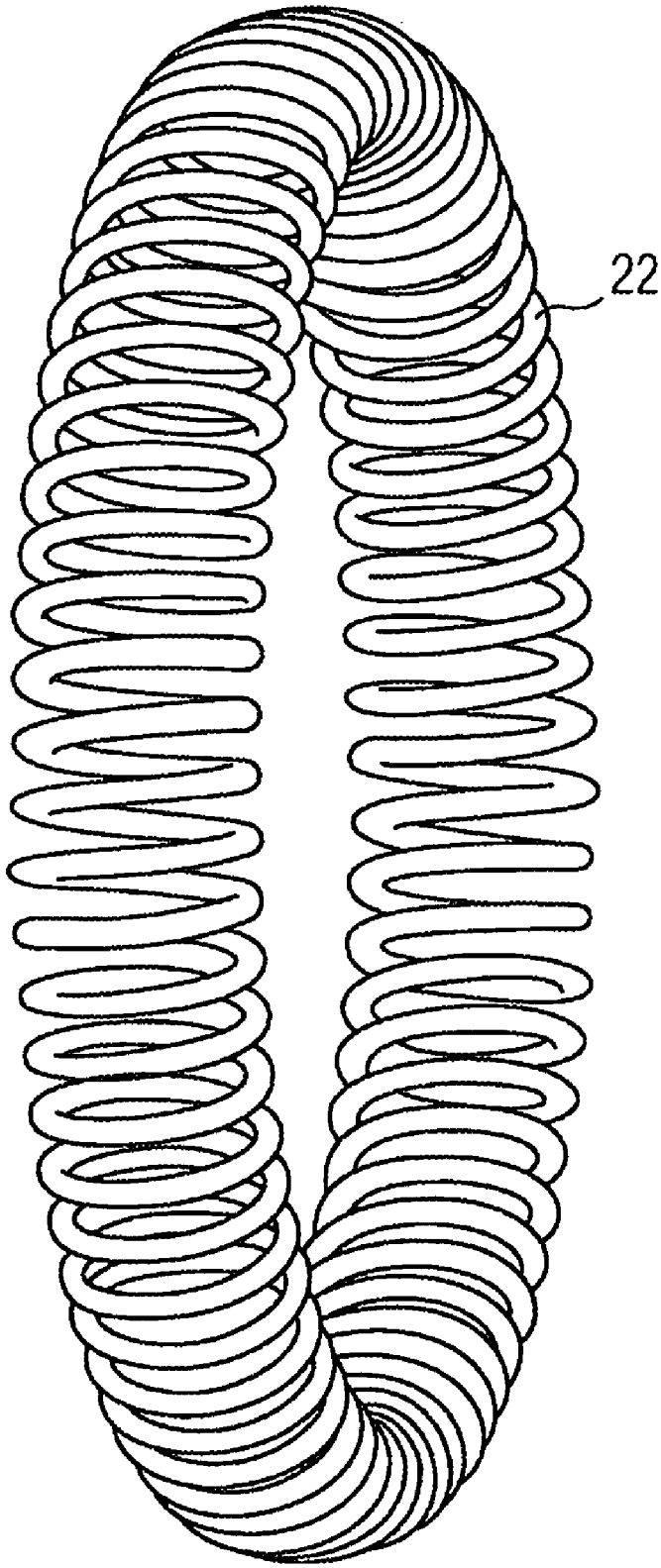
FIG. 5 shows an example of an annular spring acting as the contact element.

FIG. 5 shows, for further illustrative purposes, an example of an annular spring 22. Springs can also be used which deviate from the spring 22 illustrated in terms of their inner diameter, their outer diameter, their winding dimensions and/or their wire diameter. Instead of the annular springs, other spring-elastic elements can also be used, for example laminated contacts.

Although cylindrical pins and annular sleeves and connections are described in the exemplary embodiment, these elements may also have other geometric shapes, for example pins with oval or polygonal cross-sectional surfaces and sleeves and connections with oval and polygonal openings.

The invention claimed is:

1. A switch for a switchgear assembly, comprising:

a first connection having a first pin with a given cross-sectional dimension;

a second connection having a second pin with a given cross-sectional dimension disposed in axial extension of said first pin, adjacent thereto, spaced apart therefrom, and axially aligned therewith;

a sleeve formed with an opening having an opening dimension greater than said given cross-sectional dimension of said first pin and of said second pin, said sleeve being disposed axially displaceable on said first pin and partially on said second pin;

at least one first contact element disposed between a surface of said first pin and an inner surface of said sleeve;

at least one second contact element disposed and configured to be located between a surface of said second pin and the inner surface of said sleeve, when said sleeve is partially displaced onto said second pin;

a third connection formed with an opening having an opening dimension greater than an outer dimension of said sleeve and disposed to enable said sleeve to be displaceable between said first pin and said third connection; and at least one third contact element disposed and configured to be located between an inner surface of said third connection and an outer surface of said sleeve, when said sleeve has been displaced between said first pin and said third connection.

2. The switch according to claim 1, wherein said first pin is guided through the opening of said third connection.

3. The switch according to claim 1, wherein said sleeve has at least one holder for said at least one third contact element on the outer surface of said sleeve.

4. The switch according to claim 3, wherein said at least one holder is formed of two mutually parallel webs, and said at least one third contact element is embedded between said webs.

5. The switch according to claim 4, wherein said two webs border a trapezoidal groove.

6. The switch according to claim 3, wherein the opening dimension of said third connection is greater than the outer dimension of said sleeve at a position of said at least one holder.

7. The switch according to claim 1, wherein the cross-sectional dimensions of said first pin and of said second pin are substantially identical.

8. The switch according to claim 1, wherein said at least one first contact element is disposed on said first pin.

9. The switch according to claim 1, wherein said at least one second contact element is disposed on said first pin or on said second pin.

10. The switch according to claim 1, wherein the inner surface of said sleeve is formed with at least two cutouts, said at least two cutouts are spaced apart from one another in the axial direction and are configured for accommodating said at least one first contact element and said at least one second contact element.

11. The switch according to claim 1, wherein said first pin, said second pin, said sleeve, and said third connection are formed of an electrically conductive material.

12. The switch according to claim 1, wherein at least one of said at least one first contact element, said at least one second contact element, and said at least one third contact element are spring-elastic.

13. The switch according to claim 1, wherein at least one of said at least one first contact element, said at least one second contact element, and said at least one third contact element are an annular spring or a lamella contact.

14. The switch according to claim 1, wherein said first pin is a leadthrough pin for connecting the switch to a circuit breaker or to a busbar.

15. The switch according to claim 1, wherein said second pin is a leadthrough pin for connecting the switch to a busbar or to a circuit breaker.

16. The switch according to claim 1, wherein said third connection is configured for connecting the switch to ground potential.

17. The switch according to claim 1, configured for a power supply and distribution system.

* * * * *